US005186461A

United States Patent [19]

Tucker

[11] Patent Number: 5,186,461

[45] Date of Patent: Feb. 16, 1993

[54] SIMULATED FOOTBALL BOARD GAME

[76] Inventor: Donald K. Tucker, 92½ Montcalm, Glens Falls, N.Y. 12801

[21] Appl. No.: 745,210

[22] Filed: Aug. 12, 1991

[51] Int. Cl.[5] ..... A63F 3/00

[52] U.S. Cl. ..... 273/94; 273/247; 273/353

[58] Field of Search ..... 273/94, 93 C, 244, 247, 273/259, 277, 283, 298, 353, 126 R; D21/27, 29

[56] References Cited

U.S. PATENT DOCUMENTS

| | | | |
|---|---|---|---|
| 1,701,655 | 2/1929 | Andrews | 273/94 |
| 1,929,757 | 10/1933 | Sargent | 273/94 R |
| 1,992,475 | 2/1935 | DeHart | 273/247 |
| 2,212,838 | 8/1940 | Kuehne | 273/94 |
| 2,743,105 | 4/1956 | Westbrook | 273/94 R |
| 3,043,594 | 7/1962 | Seitz | 273/247 X |
| 3,947,039 | 3/1976 | Sadler et al. | 273/247 |
| 4,173,346 | 11/1979 | Godwin | 273/94 R X |
| 4,183,531 | 1/1980 | White | 273/94 |
| 4,524,975 | 6/1985 | Caughie et al. | 273/247 |
| 4,550,911 | 11/1985 | Daley | 273/94 |
| 4,733,867 | 3/1988 | Kemp et al. | 273/94 |
| 4,759,549 | 7/1988 | Beckwith | 273/247 X |
| 4,762,323 | 8/1988 | Blagg | 273/94 X |
| 4,773,650 | 9/1988 | Doughty | 273/247 |

FOREIGN PATENT DOCUMENTS

| | | | |
|---|---|---|---|
| 1027998 | 5/1966 | United Kingdom | 273/247 |

OTHER PUBLICATIONS

Ad for "Super Star Sports Games", published Dec. 1977.

*Primary Examiner*—V. Millin
*Assistant Examiner*—Sebastiano Passaniti

[57] ABSTRACT

A simulated football game includes a game board having yard line delineations thereon simulating a football field. The game board has a plurality of areas designated thereon having indicia indicative of the occurrence of a particular play. The game also includes a field goal die, a simulated game ball, a deck of pass cards, a deck of penalty cards, a big play die, and a field goal post means. The game is played by tapping the game ball towards the opposite end of the field. The results of the play are dictated by the area of the game board where the ball comes to rest.

7 Claims, 2 Drawing Sheets

SIMULATED FOOTBALL BOARD GAME

BACKGROUND OF THE INVENTION

This invention relates to the field of board games and more particularly to a simulated board football game.

For decades now, people have been entertained by watching the sport of American football. The sport has gained a tremendous following by fans who enjoy its excitement, physical play, speed and strategy. The excitement generated by viewing live professional football is difficult to achieve with various simulated football board games. One of the reasons why it is difficult to simulate American football with a board game is that the sport contains many facets within a game. For example, there exists a kicking game, an offensive game and a defensive game. The offensive game is generally divided into a running game and a passing game. The defensive game is generally divided into various techniques to defend against an offensive run or a pass. Scoring is achieved by advancing the ball into an end zone or by kicking field goals. The offensive team advances the ball in a play, normally referred to as a "down". If the offensive team advances the ball ten yards within four downs, the team is allowed an extra set of four downs to continue advancement of the ball. The team has an option on the fourth down to punt the ball to the opposing team which then takes possession and plays on offense. Alternatively, a team may attempt to kick a field goal if it is in field goal range.

Because of all the various intricacies involved in each of the aforementioned phases of the game, it is difficult to devise a simulated board football game which encompasses most or all of the aforementioned phases of the game. Moreover, it is difficult to devise a simulated board football game which allows the players to use some sort of skill in a simulated game.

It is therefore an object of the present invention to provide a simulated board football game which encompasses many of the phases of football.

It is also an object of the present invention to provide a simulated football game which involves some level of skill on the part of the players.

It is also an object of the present invention to provide a simulated football game which allows the participants to simulate scoring touchdowns and simulate kicking field goals.

SUMMARY OF THE INVENTION

The aforementioned objects and advantages may be achieved through a simulation football game in accordance with the present invention. The simulated football game includes a game board having yard line delineations thereon simulating a football field. The game board further comprises a plurality of areas delineated thereon, each area having an indicia indicative of the occurrence of a particular play, a field goal die comprising one or more sides, each side having an indicia thereon indicative of the distance of a field goal attempt. A simulated ball capable of sliding along the game board, a deck of penalty cards, each card having indicia thereon indicative of the type of penalty, a deck of pass cards, each card having indicia thereon indicative of the results of pass play, a big play die having indicia thereon indicative of the results of a play, said big play die to be rolled when said ball comes to rest in an area of the game board having indicia thereon indicative of an instruction to roll the big play, and field goal post means for flicking the simulated ball therethrough during a field goal attempt.

The simulated football game may further comprise a field goal blocker. The area is delineated on the game board having indicia thereon indicative of a particular play may include one or more areas having indicia thereon indicative of a penalty, one or more areas having indicia thereon indicative of a sack, one or more areas having indicia thereon indicative of a pass, and one or more areas having indicia thereon indicative of a turnover.

The deck of pass cards may comprise pass cards having indicia thereon indicative of a completion of a pass and the yardage gained on the completion, indicia thereon indicative that the results of a pass play is an incompletion, indicia thereon indicative that the results of a pass play is an interception.

The big play die may contain indicia on the sides thereof including indicia indicative of the big play as a touchdown, indicia indicative that a field goal is to be attempted, indicia indicative of the results of a run play, indicia indicative of the results of a pass play, indicia indicative that the results of a big play is a safety and indicia indicative that the results of a big play is a first down.

Each penalty card may have indicia thereon indicative of the effect of a penalty in a particular play.

The simulated football game also comprises a method of playing a simulated football game which comprises tapping a simulated football along the game board having yard line delineations thereon simulating a football field. The game board comprises a plurality of areas delineated thereon, each area having indicia indicative of the accounts of a particular play. Drawing a pass card from a deck of pass cards as a result of the simulated ball being tapped into an area of the game board having indicia thereon indicative that a pass card is to be drawn, rolling a big play die as a result of the simulated ball being tapped into an area of the game board having indicia thereon indicative that the big play die is to be rolled, drawing a penalty card as a result of the simulated ball being tapped into an area of the game board having indicia thereon indicative that a penalty card is to be drawn, awarding points as a result of the simulated ball being tapped so that a portion of the ball is in contact with the edge of the end portion of the game board.

DETAILED DESCRIPTION

The object of the simulated board football game in accordance with the present invention is similar to that of American football. Each team scores points by advancing the ball down field towards the opponents goal. As described herein, a board is used as the field and the rules differ slightly. However, during play the rules and terminology are similar to that of American football unless indicated to the contrary herein.

Figure 1:
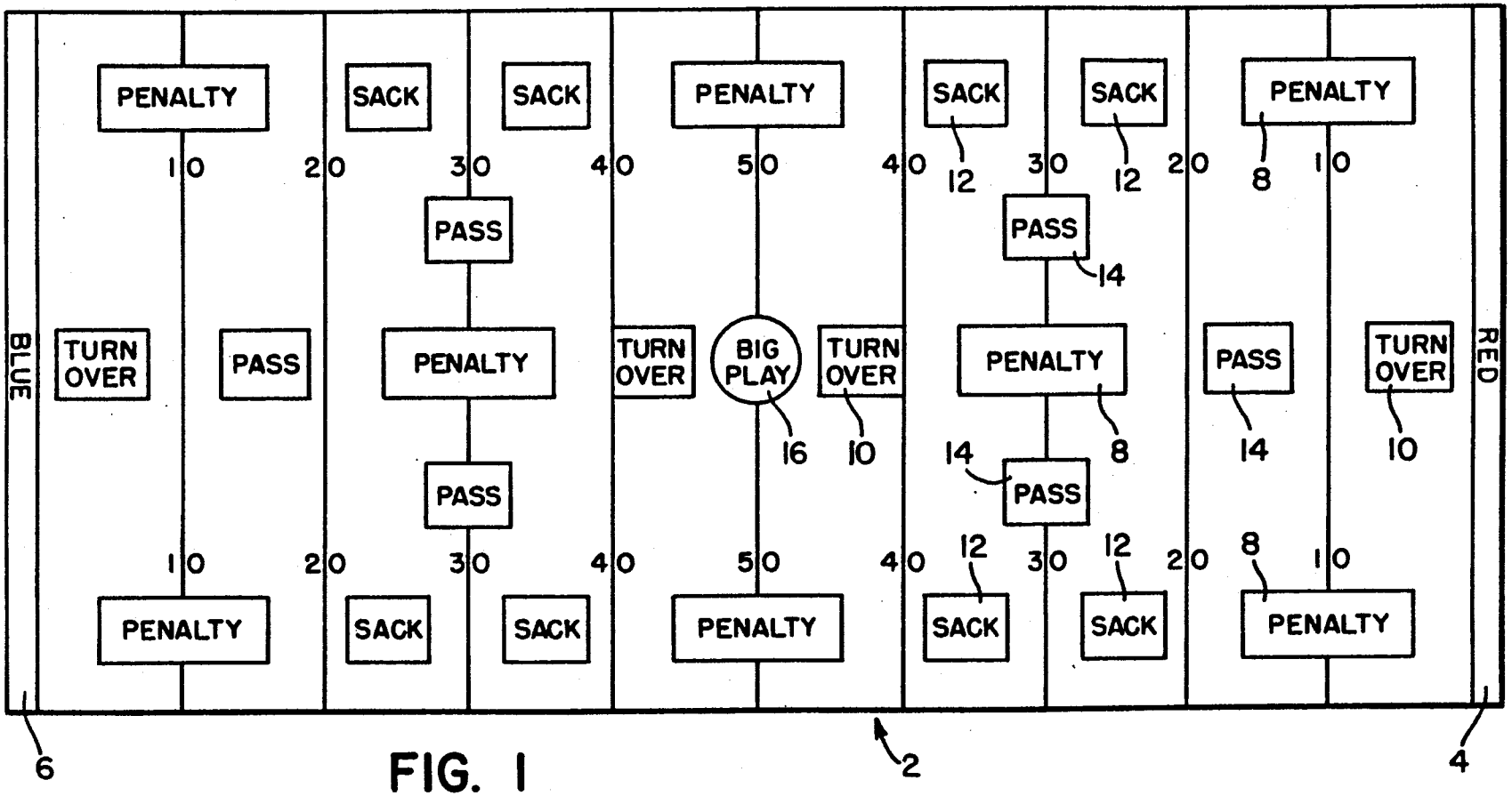
FIG. 1 is a top view of the game board useable in the simulated board football game of the present invention.

Referring to the drawings, FIG. 1 depicts the game board 2 useable for playing the simulated board football game. The board contains delineations thereon simulating a football field. The delineations include yard lines marked as the 10, 20, 30 and 40 yard lines located on each side of the field which is divided by a fifty yard line. Each end of the game board contains a field goal line 4, 6 which are preferably depicted in different arbitrarily chosen colors, each color indicative of a team's side of play. The game board further comprises a plurality of areas 8, 10, 12, 14, 16 designated thereon. The areas contain indicia delineated thereon which are indicative of the occurrence of a particular play. The areas include indicia which read penalty 8 (or the equivalent), turnover 10 (or the equivalent), sack 12 (or the equivalent), and pass 14 (or the equivalent). These areas are located at particular locations such as those shown in FIG. 1. However, it is possible that these areas may be located at different positions on the game board and the invention is not limited to any particular game board with one set pattern of designated areas.

At the 50 yard line, a circle 16 is located and contains the designation "Big Play" (or the equivalent) thereon. During play, when the game ball is tapped into an area which contains any of the aforementioned indicia thereon. Certain rules of play, discussed infra, must be followed. The game board may be of various dimensions. However, it is preferred that the game board be of sufficient surface area to allow a player to develop a skill for tapping a simulated football there across. It has been found that a game board of approximately 24 inches wide by 75 inches long is sufficiently large enough to suffice for these purposes. However, other sizes may also suffice and the invention is not limited to any particular size. The board may be constructed of one inch thick polymeric foam. However, any particular material may suffice. It is also preferred that the surface of the game board be of a smooth texture, such as laminated plastic, to allow the simulated game ball to be slidable thereon.

The game includes a deck of pass cards. Various number of cards may be used within the deck of pass cards, and the invention is not limited to any particular number of cards. However, the pass cards should include cards which contain indicia thereon indicative of the results of a simulated pass play. The indicia may be words printed on the cards which indicate if a pass has been completed, incompleted or intercepted. Preferably, 30 pass cards in a deck may be used. These 30 pass cards may comprise a various combinations of results printed thereon. However, it has been found that the 30 pass cards may include eight cards having printed thereon the words "incomplete", one card having printed thereon the word "intercepted", and 21 cards having printed thereon the word "complete" including indicia thereon indicative of the yardage of the completion. The completion cards may have the following yardage printed thereon:

5 yards, 10 yards, 15 yards, 20 yards,
22 yards, 24 yards, 26 yards, 28 yards,
30 yards, 32 yards, 34 yards, 36 yards,
38 yards, 40 yards, 42 yards, 44 yards,
45 yards, 48 yards, 50 yards, 55 yards and
60 yards.

A pass card is drawn during play when the ball is tapped onto one of the designated areas 14 of the board having the indicia "pass" (or the equivalent) indicated thereon. The player who tapped the ball, then draws a pass card which indicates the results of that particular play thereby simulating a pass play of real football.

The game also comprises one or more "Big Play" die which is to be rolled by the offensive team when the simulated ball is tapped into the big play circle located at midfield of the game board. Preferably, only one big play die is needed during play. The "Big Play" die may be six sided, each side having indicia thereon. The indicia may include printed designations or printed words which indicate the results of a big play which is the simulated play which occurs when the ball is tapped into the big play circle. Each side of the "Big Play" die may have the following printed thereon:

touchdown, field goal, 30 yard run, 45 yard pass, safety and first down.

Although the aforementioned words may be printed thereon to indicate the results of a "Big Play", the invention is not limited to one particular configuration of the big play die. Various other sided dies may be used as the "Big Play" die and other designations representing different results of a "Big Play" may also be used and the invention is not limited to any one particular configuration or embodiment.

The simulated board football game also comprises a deck of penalty cards. A card from the deck of Penalty Cards (i.e., "Penalty Card") is drawn, preferably by the offensive player, when the ball is tapped into an area of the game board 2 designated with the word "penalty" (or the equivalent) thereon. Preferably, there should be 30 penalty cards each card having an indicia thereon indicative of the penalty assessed on a particular play. The penalty cards may comprise the following, including the quoted printed indicia and yardage assessed per penalty, thereon:

6 "holding" cards, "10 yards"; 3 "personal foul" cards, 25 "yards plus loss of down"; 3 "pass interference" cards; 10 "yards plus loss of down"; 4 "offsides" cards; "5 yards"; 1 "face mask card"; 15 "yards plus loss of down"; 3 "illegal block" cards; "10 yards"; 4 "clipping" cards; 15 "yards plus loss of down"; 3 "illegal formation" cards; "10 yards"; 3 "illegal man down field" cards; 10 "yards plus loss of down".

Although the aforementioned penalty cards have been used successfully in the simulated board football game, the invention is not limited to the aforementioned combination of cards with the aforementioned designations thereon. Various other combinations of penalty cards with other designations indicative of the assessments of a particular penalty on a particular play may be used.

Figure 2:
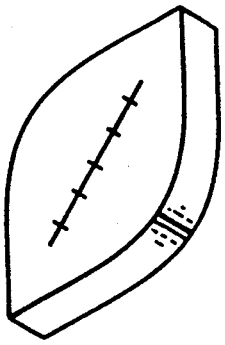
FIG. 2 is a isometric view of the game ball useable during play of the simulated board football game.

Referring to FIG. 2, the simulated ball (referred to herein as "ball") is configured as a simulated football in shape having a thickness and surface area similar to a football. Preferably, it has been found that the length of the game ball should be $2\frac{3}{4}$ inches while the height being 1 and $\frac{3}{8}$ inches and the thickness $\frac{5}{8}$ of an inch. The ball may also be made of polymeric foam, however, other materials may also suffice. Also, the ball may be of various other dimensions and the invention is not limited to any particular dimension.

Figure 3:
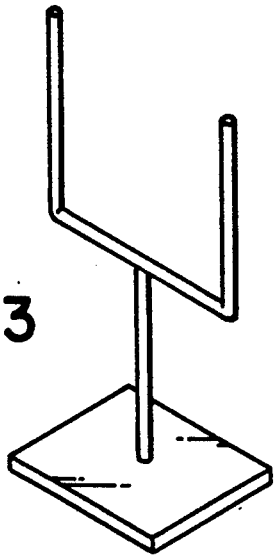
FIG. 3 is depicts an isometric view of a goal post useable during play of the simulated board football game in accordance with the present invention.

FIG. 3 depicts a simulated field goal post which is to be used during field goal attempts. A player attempts a field goal by flicking the simulated ball through the uprights of the simulated field goal post which is placed at or near the end of the game board. The ball is flicked by a player by holding the point of the ball on the board by his or her index finger such that the ball is upright and striking the ball using the opposite hand in the direction of the field goal post. Three points are awarded if the ball passes through the uprights of the simulated field goal post. The simulated football post may be of various particular dimensions and the invention is not limited to one particular dimension, the wider the uprights and higher the cross bar. Therefore, the particular heights of the cross bar and width of the uprights may be varied depending upon the desired difficulty of play.

Figure 4:
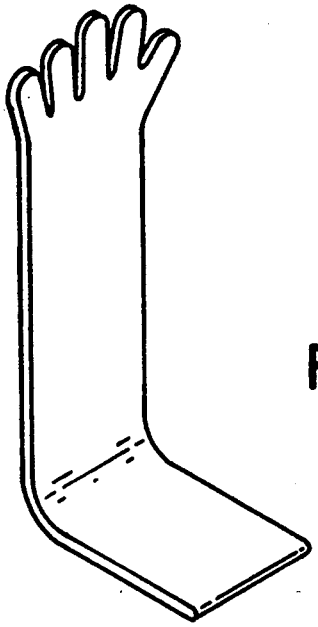
FIG. 4 depicts a blocker useable during play of the simulated board football game in accordance with the present invention.
Figure 6A:
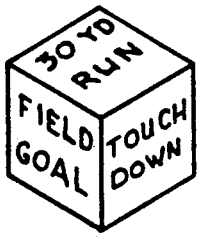
FIGS. 6A and 6B depict the big play die and field goal die, respectively, useable during play of the simulated board game in accordance with the present invention.
Figure 6B:
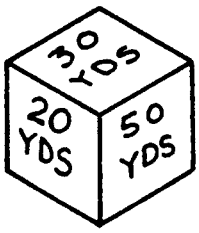
Figure 5A:
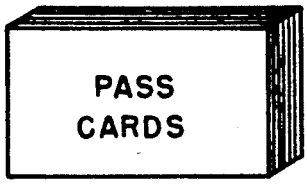
FIGS. 5A and 5B depict the pass cards and penalty cards, respectively, useable during play of the simulated board football game in accordance with the present invention.
Figure 5B:
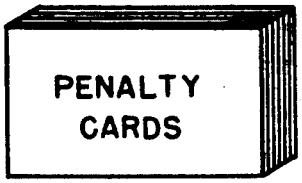

FIG. 4 depicts a field goal blocker which comprises a substantially L-shaped member having a curved bottom and corner. The member may have the shape of a hand at the top thereof. The long section of the blocker is placed 10 yards from the spot of the game ball by the team or person attempting a field goal. When the ball is kicked, the defensive team or player depresses their finger at the short end of the member to raise the long end of the member in an attempt to block the field goal with the top or long end of the member. If the field goal is blocked, no points are awarded for the field goal attempt.

The game is played using the rules substantially derived from the rules of American football. The game is begun by a "kickoff" where the ball is held upright by a kicking team player and flicked with the finger similar to the flicking of a field goal, on the 20 yard line of the kicking team. Where the ball lands, is the location of the ball or line of scrimmage of the receiving team for its first offensive play. If the ball is flicked over the end of the board during a kickoff then the ball is placed at the 20 yard line.

The offensive player then on its first play (commonly referred to as a down or tap) taps the ball with his or her fingertips towards the opposing player's end of the field. The ball is tapped by flicking the ball along the surface of the board 2. Where the ball comes to rest dictates the occurrence of a particular play. If the ball comes to rest on a location of the board which does not include an area designated with writing, the offensive player or team then may attempt another tap of the ball, as its next down, towards the opposing player's end of the board. A player has four taps, or downs, per series. If a touchdown is not scored or a field goal is not attempted, the opposing player will take over at the spot where the ball comes to rest on fourth down or where the ball ends up as a result of the fourth down.

If during any of the four downs, a ball is tapped into an area 14 having the designation "pass" (or the equivalent) thereon, the offensive player can draw a pass card from the deck of pass cards for that particular down. The results of the pass play are dictated by the written indicia on the particular pass card drawn. For example, a pass may be complete (for a particular number of yards), incompleted, or intercepted. If the pass is complete, the ball is advanced for the number of yards designated and one down is assessed. The offensive player taps again using the next down or tap. Yards advanced, of course, correspond to the yard line delineations printed on the game board 2. If the pass is incomplete, the ball is left at that location in pass area 14 where it was tapped from and the next tap or down occurs. If the pass is intercepted, the opposing player receives the ball and begins its offensive set of taps, or downs, at the locations where the first player tapped the ball into the pass area 14.

If the ball is tapped into the area 16 of the game board designated "Big Play" (or the equivalent), the offensive team or player may roll the "Big Play" die. The results of that particular play are dictated by the roll of the "Big Play" die. For example, if the "Big Play" die is rolled such that the printed designation "touchdown" (or the equivalent) appears thereon at the top, then the result of the play is a touchdown. The results of the big play may comprise a field goal, 30 yard run, 45 yard pass, safety and first down and the corresponding designations are printed on the "Big Play" die. However, other results indicate by other indicia may be used.

If the ball is tapped into an area 8 designated with the word "penalty" (or the equivalent) thereon, a player draws a penalty card from the deck of penalty cards which will dictate the results of the penalty. A player will have the ball moved backwards as a result of the printed designations on the drawn penalty card. The next down or tap occurs at the location (i.e, line of scrimmage) dictated by the penalty card.

If the ball is tapped off the game board, then the play is designated as an off. Three accumulated "offs" by any player during one half will allow the opposing player to attempt a field goal at a location as dictated by a roll of the field goal die.

If the ball is tapped to an area 12 designated with the word "sack" (or the equivalent), the ball is left there and one tap or down is lost. Therefore, a loss of one down results.

If the ball is tapped into an area 10 of the board with the designation "turnover" (or the equivalent) thereon, the opposing team receives the ball for a set of downs or taps at the particular turnover area 10 of the board 2 where the ball landed.

Scoring is achieved when the ball is tapped so that a portion of the ball is hanging over the edge 4, 6 of the game board at the opposing player's end. When this occurs, a touchdown is awarded and six points are accumulated. A touchdown may also be scored when a pass card is drawn and the yardage assessed advances the ball no more than 10 yards over the field goal line 4,6. A touch down may also be awarded when the big play die is rolled and the indicia "touchdown", or the equivalent, appear on the top face. Field goals may be achieved by flicking the ball through the goal post with the index finger while holding the ball with the opposite hand. Field goals may be attempted when the offensive player taps the ball into the colored end of the board i.e., the field goal zone. A field goal may also be attempted when the results of rolling the big play die indicate "field goal", or the equivalent, on the top face. A field goal may also be attempted when the opposing player or team accumulates three "offs". A "safety" results in two points and may be scored only by rolling a big play die such that the words safety appears at the top face. Extra points are attempted after a touchdown is scored and one point is awarded if the ball is kicked (i.e., flicked) through the uprights from the ten yard line of the opposing player's end of the field. Alternatively, a two point conversion is an optional feature of the game and may be awarded to a team who scores a touchdown by tapping the ball from the ten yard line towards the end zone, if the ball passes over the edge of the end zone without falling off the board.

Typically two 15 minute halves are played. However, the expiration of time for the halves may be varied. If the game is tied after regulation play, then overtime may be played and may either be a "sudden death overtime" or an overtime for a particular length of time to be agreed upon the players.

The following rules of play in more detail describe the governing rules. However, the rules may be varied to accommodate or suit a particular player. For example, although specific indicia have been described herein, other indicia depicting alternative results or occurrences may be used.

RULES OF PLAY

I. Advancing the Ball

A. Kick Off—The ball is held upright and flicked with a finger by the kicking team from the kicking team's own 20 yard toward the opposing players goal line 4, 6.

B. Taps (i.e., Downs)—The ball is tapped with fingertips by the offensive team to advance as if running the ball. There are four downs (or taps) per series. If a touchdown or field goal is not scored, the opposing player takes over at the spot where the ball comes to rest.

C. Pass Cards—When the ball is tapped into one of the "pass" squares 14 on the board 2, a pass card is drawn, and another down is used. The pass cards denote the outcome of the pass play. The pass cards or instructions may include results such as:

1.) Complete for a certain number of yards. In this situation, the ball is advanced for the number of yards on the card and one down is used.

2.) Incomplete pass. In this situation, no yardage is gained and there is loss of the down.

3.) Interception. In this situation, possession of the ball goes to the opposing player at that spot on the board. The opposing player then attempts to advance the ball by downs or taps.

Note: When advancing the ball after a pass card is drawn, disregard any squares the ball may be placed in.

D. Big Play Die—This die is rolled when the ball is tapped into the "Big Play" circle 16 at midfield of the board 2. The six sides of the die denote "Big Plays". The roll of the die accounts for one down.

1.) Touch Down—Six points are scored and extra point is then attempted. The ball is then kicked from the 20 yard line.

2.) Fieldgoal—The field goal die is rolled to determine the distance of the kick (i.e., flick). The ball is flicked from an upright position toward the field goal post from the determined distance. If the ball passes through the goal posts, 3 points are awarded. If the ball does not pass through the goal posts, the opposite player gains position at location on the board of the field goal attempt.

3.) 30 Yard Run—The ball is advanced to the opponents 20 yard line from midfield.

4. ) 45 Yard Pass—The ball is advanced to the opponents 5 yard line from midfield.

5.) Safety—2 points are gained and ball is kicked by the opposing team from their 20 yard line.

6.) First Down—Four new downs (taps) from midfield.

II. PENALTIES

A. Penalty Flags: Penalty are assessed when ever the ball is tapped into contact with one of the penalty squares 8 on the board 2. A penalty "flag" (i.e., card) is drawn indicating the particular penalty. The resulting penalty is assessed from the point where the ball came to rest.

B. Penalties Out of Bounds: This is a penalty whenever the ball is tapped off the board on any side. A penalty flag is *not* drawn, but the penalty is recorded as "1 off". Three accumulated "offs" by any player during one half allows the opposite player an attempt at a field goal. The field goal die is rolled to determine the distance of the attempt. If the field goal is made, 3 points are gained and the ball is kicked off to the opposing player. If the field goal is missed, the opposing player takes control of the ball from where it was kicked. After the field goal attempt, the record of "penalties out of bounds" begins at 0-off" and the cycle starts again.

III. Sack and Turn Over

A. Sack—When the ball is tapped into contact with one of the sack squares 12 on the board 2 a loss of down results.

B. Turn Over—When the ball is tapped into contact with one of the turnover square 10 on the board 2, it is turned over to the opposing team at that spot on the board.

IV. Scoring:

A Touchdown—6 points scored by the following:

1.) Tapping: When the ball is tapped so that some of the ball is hanging over the edge 4, 6 of the end zone of the opposing player without falling off the board 2.

2.) Passcards: When a pass card is drawn and the yardage assessed puts the ball no more than 10 yards over the end zone, a touchdown is scored.

3.) Big Play Die: When the "big play" die is rolled and a "T.D." or "Touchdown" appears face up, a touchdown is scored.

Note: After touchdowns are scored, an extra point or two point conversion can be attempted by the offensive player.

B. Fieldgoals—3 points are awarded by flicking the ball through the goal posts with the index finger, while holding the ball in an upright position with the index or middle finger of the other hand. Possibilities for attempts of field goals include the following:

1.) Field coal zone: When the offensive player taps the ball into the field goal zone in the end zone. The field goal attempt must be taken whenever the ball comes to rest in this zone.

2.) Big Play Die: When the player rolls the big play die and "FG" or "Field Goal" faces up the field goal attempt is rewarded.

3.) "3-Off": When the offensive player taps the ball off the board any three times in one half of play, the defensive player is rewarded a field goal attempt.

Note: Each field goal attempt is kicked (i.e., flicked) from the yardage determined from the kickers roll of the field goal die.

C. Safety—2 points scored only by rolling the "big play" die such that "Safety" appears.

D. Extra Point—1 point has been scored after a touchdown has been scored by kicking the ball through the goal posts from 10 yards away.

E. Two Point Conversion—This is done after a touchdown is scored by tapping the ball from the 10 yard line toward the end zone. If the ball passes over the edge of the end zone without falling off the board, 2 points are gained.

V. Time

Two 15 minute halves are played.

VI. DEFENSE

This is mainly the board. There is a field goal blocker provided for defense. This is placed ten yards from the offensive players line of scrimmage. The defensive player only has one attempt at blocking the kick, which is done by flicking the blocker up into the flight path of the ball. If the goal is blocked, no points are gained. The goal blocker is placed 10 yards from the ball on extra point trays.

VII. Winning

The player and/or team with the most points at the end of the game wins.

VIII. Overtime

This is an additional 15 minutes played at the end of the second half if the score is tied. The player with the most points at the end of the 15 minutes is the winner.

Although the invention has been described with reference to the embodiment herein, various modification may be apparent to one skilled in the art. Any such modifications are intended to be within the scope of the invention as defined by the following claims.

What is claimed is:

1. A simulated football game comprising:
   - a game board having yard line delineations thereon simulating a football field, said game board further comprising a plurality of areas delineated thereon, each area having an indicia indicative of an occurrence of a particular play;
   - a field goal die comprising one or more sides, each side having an indicia thereon indicative of distance of a field goal attempt;
   - a simulated ball capable of sliding along the game board;
   - a deck of penalty cards, each card having indicia thereon indicative of a type of penalty associated with at least one of said particular plays;
   - a deck of pass cards, each card having indicia thereon indicative of results of a pass play associated with at least of one said particular plays;
   - a bid play die having indicia thereon indicative of results of a bid play, said big play die capable of being rolled when said ball comes to rest on an area of the board having indicia thereon indicative of an instruction to roll the big play dei; and
   - field goal post means for flicking the simulated ball therethrough during a field goal attempt.

2. The simulated football game of claim 1 further comprising a field goal blocker.

3. The simulated football game of claim 1 wherein the areas delineated on the game board having indicia thereon indicative of the occurrence of the particular play comprise:
   - one or more areas having indicia thereon indicative of a penalty;
   - one or more areas having indicia thereon indicative of a sack;
   - one or more areas having indicia thereon indicative of a pass; and
   - one or more areas having indicia thereon indicative of a turnover.

4. The simulated football game of claim 3 wherein the pass cards comprise:
   - indicia thereon indicative of a completion of a pass and yardage gained on the completion;
   - indicia thereon indicative that the result of the pass play is an incompletion; and
   - indicia thereon indicative that the result of the pass play is an interception.

5. The simulated football game of claim 4 wherein the big play die contains indicia on the sides thereof comprising:
   - indicia indicative of a touchdown;
   - indicia indicative of a field goal attempt;
   - indicia indicative of results of a run play;
   - indicia indicative of the results of the pass play;
   - indicia indicative that a result of the big play is a safety; and
   - indicia indicative that a result of the big play is a first down;

6. The simulated football game of claim 5 wherein each penalty card has indicia thereon indicative of results of the penalty.

7. A method of playing a simulated football game comprising:
   - tapping a simulated football along a game board having yard line delineations thereon simulating a football field, said game board also having a plurality of areas delineated thereon, each area having indicia indicative of accounts of a particular play, and thereafter;
   - drawing a pass card from a deck of pass cards as a result of the simulated ball being tapped onto an area of the game board indicative that a pass card is to be drawn;
   - rolling a big play die as a result of the simulated ball being tapped into an area of the game board having indicia thereon indicative that the big play die is to be rolled;
   - drawing a penalty card from a deck of penalty cards as a result of the simulated football being tapped onto an area of the game board having indicia thereon indicative that a penalty card is to be drawn;
   - awarding points as a result of the simulated ball being tapped so that a portion of the ball is in contact with an edge of an in portion of the game board.

* * * * *